US006321408B1

(12) United States Patent
Esterson et al.

(10) Patent No.: US 6,321,408 B1
(45) Date of Patent: Nov. 27, 2001

(54) BASTING BRUSH WITH REPLACEABLE BRISTLE ELEMENT

(75) Inventors: Robin Esterson, New York, NY (US); Kristie M. Killen, Lighthouse Point, FL (US); Donald R. Lamond, Lynbrook, NY (US); Paul Lacotta, Glen Rock, NJ (US); Anna Stern, New York, NY (US); Bill Fiebel, Clifton, NJ (US)

(73) Assignee: Sunbeam Products, Inc., Boca Raton, FL (US)

( * ) Notice: Subject to any disclaimer, the term of this patent is extended or adjusted under 35 U.S.C. 154(b) by 0 days.

(21) Appl. No.: 09/374,420

(22) Filed: Aug. 13, 1999

(51) Int. Cl.[7] ..... A46B 5/02; A46B 9/02; A46B 7/00

(52) U.S. Cl. ..... 15/176.2; 15/176.6; 15/160; 15/143.1; 15/DIG. 5

(58) Field of Search ..... 15/160, 143.1, 15/176.1, 176.2, 176.3, 176.6, 191.1, DIG. 5

(56) References Cited

U.S. PATENT DOCUMENTS 421,812 * 2/1890 Bonner .
925,178 * 6/1909 Hardman .
1,372,108 * 3/1921 Timmis .
1,493,848 * 5/1924 Ebert .
1,513,556 * 10/1924 Lucia .
1,566,497 * 12/1925 Mevelin .
1,893,002 * 1/1933 Rothschild .
2,493,329 * 1/1950 Wirth .
3,193,863 * 7/1965 Myers .
3,757,376 * 9/1973 Coombes .
4,494,268 * 1/1985 Chu .
5,511,276 * 4/1996 Lee .
5,778,479 * 7/1998 Raia .
5,864,915 * 2/1999 Ra .
5,926,903 * 7/1999 Kim .
6,035,481 * 3/2000 Douglas .

* cited by examiner

*Primary Examiner*—Randall E. Chin
(74) *Attorney, Agent, or Firm*—Kramer Levin Naftalis & Frankel LLP.

(57) ABSTRACT

A basting brush having a replaceable bristle head provides for economical and hygienic reuse of basting brush handle portions. The brush also permits rapid twist-lock disconnection and replacement of the bristle head element. Angled bristles, a curved neck and a soft-grip hand-piece provide for improved comfort during use for more convenient basting action.

20 Claims, 5 Drawing Sheets

BASTING BRUSH WITH REPLACEABLE BRISTLE ELEMENT

FIELD OF THE INVENTION

The present invention relates generally to improvements in basting brushes and particularly basting brushes used in cooking on barbeque grills.

BACKGROUND INFORMATION

Conventional basting brushes for use in barbeque cooking suffer from a number of disadvantages. Over time, the bristles of these brushes often become contaminated with food and grease residues which decompose and harden. Microbial organisms which thrive on the food and grease residues may be inadvertently transferred to fresh meats and other foods during further use of the basting brush, and therefore pose a potentially significant health risk. Because the organic food residues tend to be concealed in nooks and crannies of the basting brush, inaccessible to typical washing procedures, the brush is rendered essentially uncleanable and therefore unusable. After a short period of time, these residue-clogged basting brushes become aesthetically and hygienically unappealing for continued use, and are discarded even though the handle portions of the brushes remain useful and their disposal is economically wasteful. A new design which permits ready replacement of the bristle portion of the basting brush would enhance the hygiene and appeal of reusing the brush, and therefore alleviate the waste of brush handles.

SUMMARY OF THE INVENTION

Accordingly, it is an object of the present invention to provide an improved basting brush having a handle and a bristle portion detachably and replaceably secured to the handle portion.

Another object of the present invention is to provide a basting brush which permits detachment and replacement of brush bristle heads, thereby extending the useful lifetime of the basting brush.

Another object of the present invention is to provide a basting brush which permits simple, convenient and quick replacement of the bristle brush head using a twist-lock or similar type connection.

Another object of the present invention is to provide a basting brush with a replaceable bristle head in order to make the basting of cooked foods a more hygienic process.

Another object of the present invention is to provide a basting brush having a curved handle for more convenient application of basting fluids.

Another object of the present invention is to provide a basting brush having angled bristles providing for more flexible basting action.

Another object of the present invention is to provide a basting brush having a soft-grip handle which would make use of the device more comfortable.

The accompanying drawings, referred to herein and constituting a part hereof, illustrate preferred embodiments of the invention and, together with the description, serve to explain the principles of the invention.

Other features and advantages of the present invention will be apparent from the following description of the preferred embodiments thereof, and from the claims.

DETAILED DESCRIPTION

Figure 1:
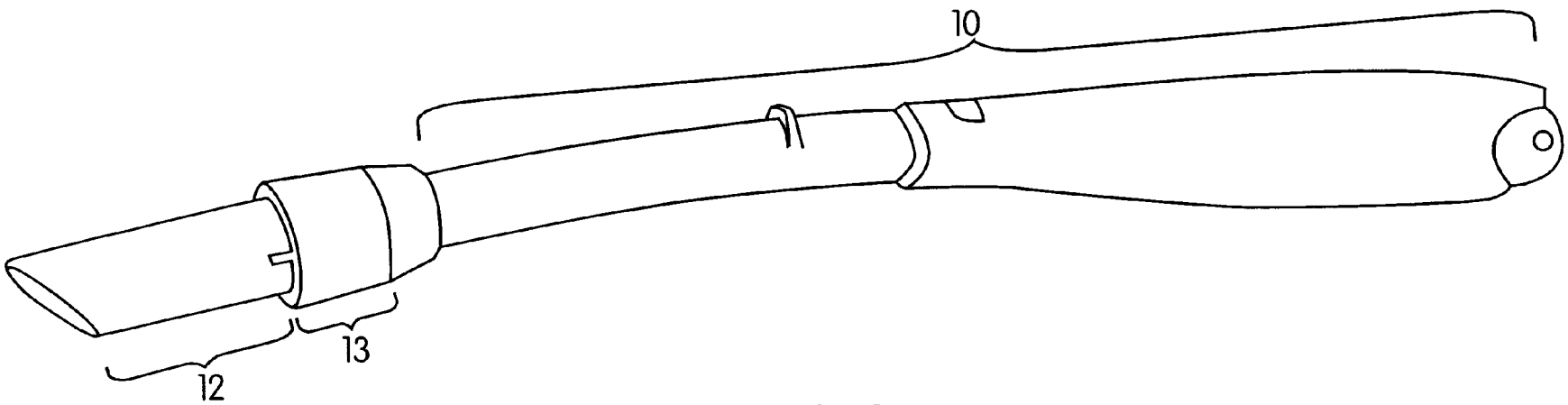
FIG. 1 is a side perspective view of an exemplary embodiment of a basting brush in accordance with the present invention.
Figure 2:
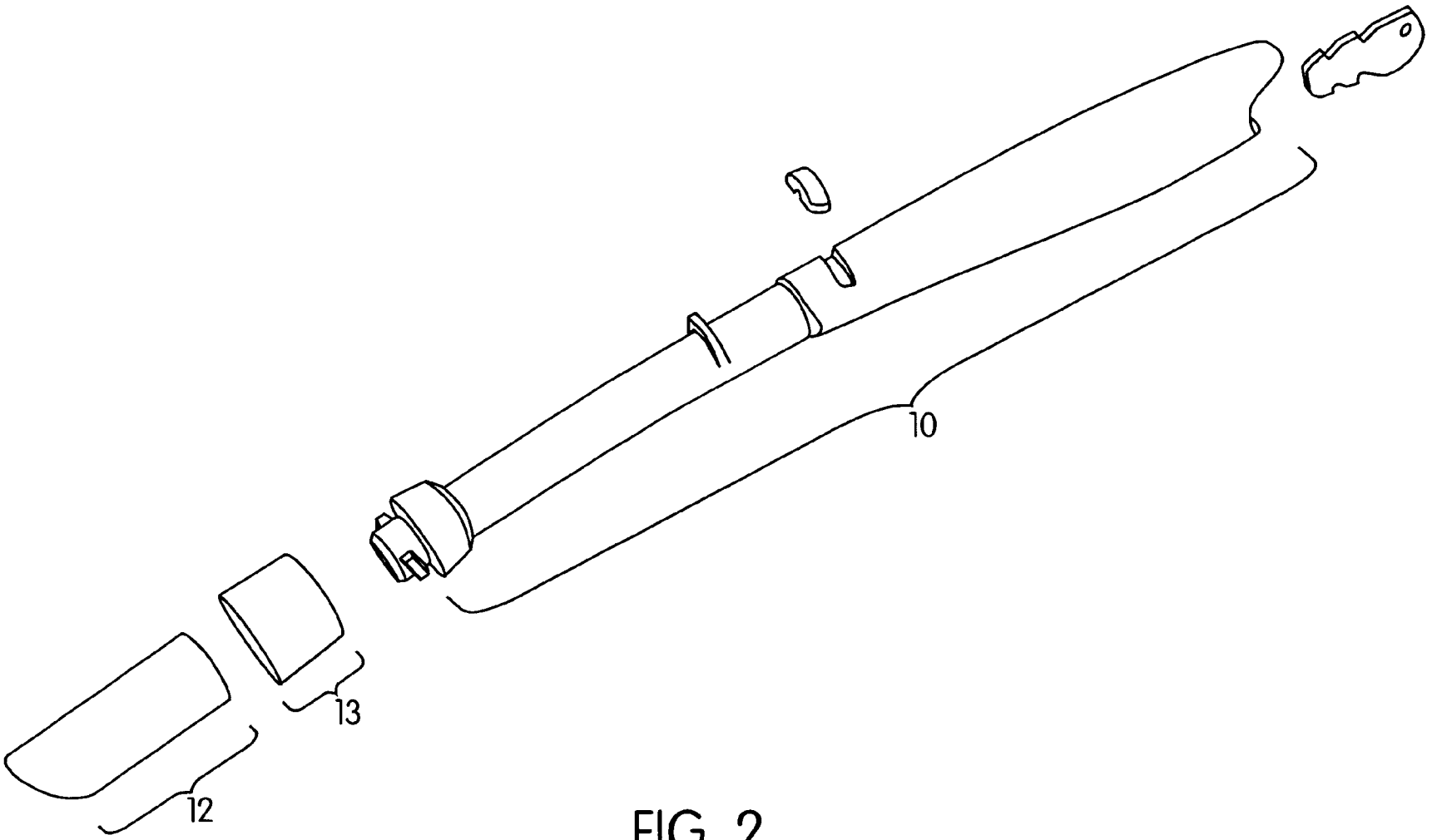
FIG. 2 is an exploded side perspective view of an exemplary embodiment of a basting brush in accordance with the present invention.

In accordance with the exemplary embodiment illustrated in the figures, such as FIGS. 1–2, the basting brush of the present invention includes handle portion 10 and a replaceable bristle head portion 12 and retaining member 13. Handle portion 10 includes, for example, handle grip section 10*a* and handle core section 10*b*. The handle grip section 10*a* is attached, for example, to the upper end of the handle core section 10*b* and may include a coated surface or overmold grip made from a deformable material which affords a comfortable grip to the handle grip section 10*a*. Such deformable material may be overmold injected and may be any suitable plastic, for example, Santoprene™. The handle portion 10 may be from about 5 inches to about 18 inches in overall length, the longer lengths being more particularly useful and safe in basting foods cooked over a barbeque where the user's hands and arms should be kept maximally distant from the heating elements of the barbeque. In the example shown in the Figures, the basting brush is about 16 inches in overall length.

The handle core section 10*b* may be injection moldable and made from a suitable plastic. In the exemplary embodiment, the handle core section 10*b* is fabricated from a thermoplastic such as polypropylene. The handle grip section 10*a* may be further modified to accept a hanging ring 16, such as a flat metal or plastic piece having a suitably dimensioned opening 16*a* from which the basting brush may hang. The hanging ring 16 may be removable or permanently bonded to the handle grip section 10*a* by any means known in the art, including a friction fit, glue bond or riveting.

Figure 5C:
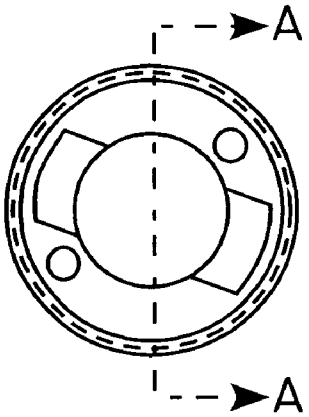
FIG. 5 includes two cross-sectional side views and a top diagrammatic view, FIGS. 5A–5C respectively, of an exemplary embodiment of a replaceable bristle head retaining ring for a basting brush in accordance with the invention.
Figure 5B:
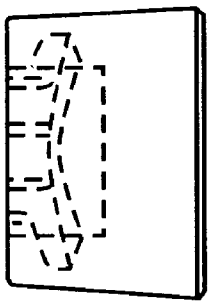
Figure 5A:
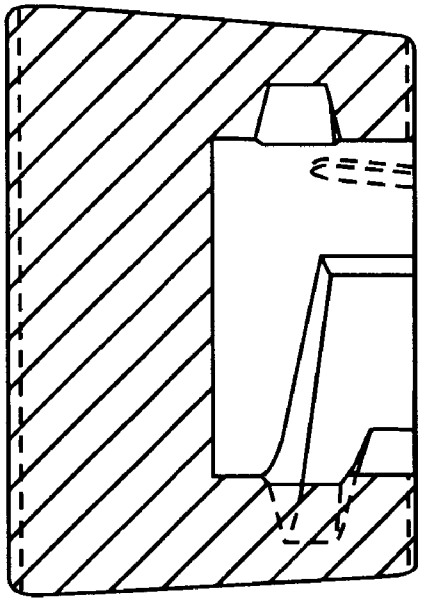

The replaceable bristle head portion 12 includes, for example, a retaining member 13, illustrated in FIG. 5. The retaining member 13 may be made of, for example, a plastic material. The retaining member 13 is in the form of, for example, a tubular body of generally rectangular cross-section in which the replaceable bristle head portion 12 is fixed by any means known in the art, including by means of glue at the inner surface of the retaining member 13.

Figure 4A:
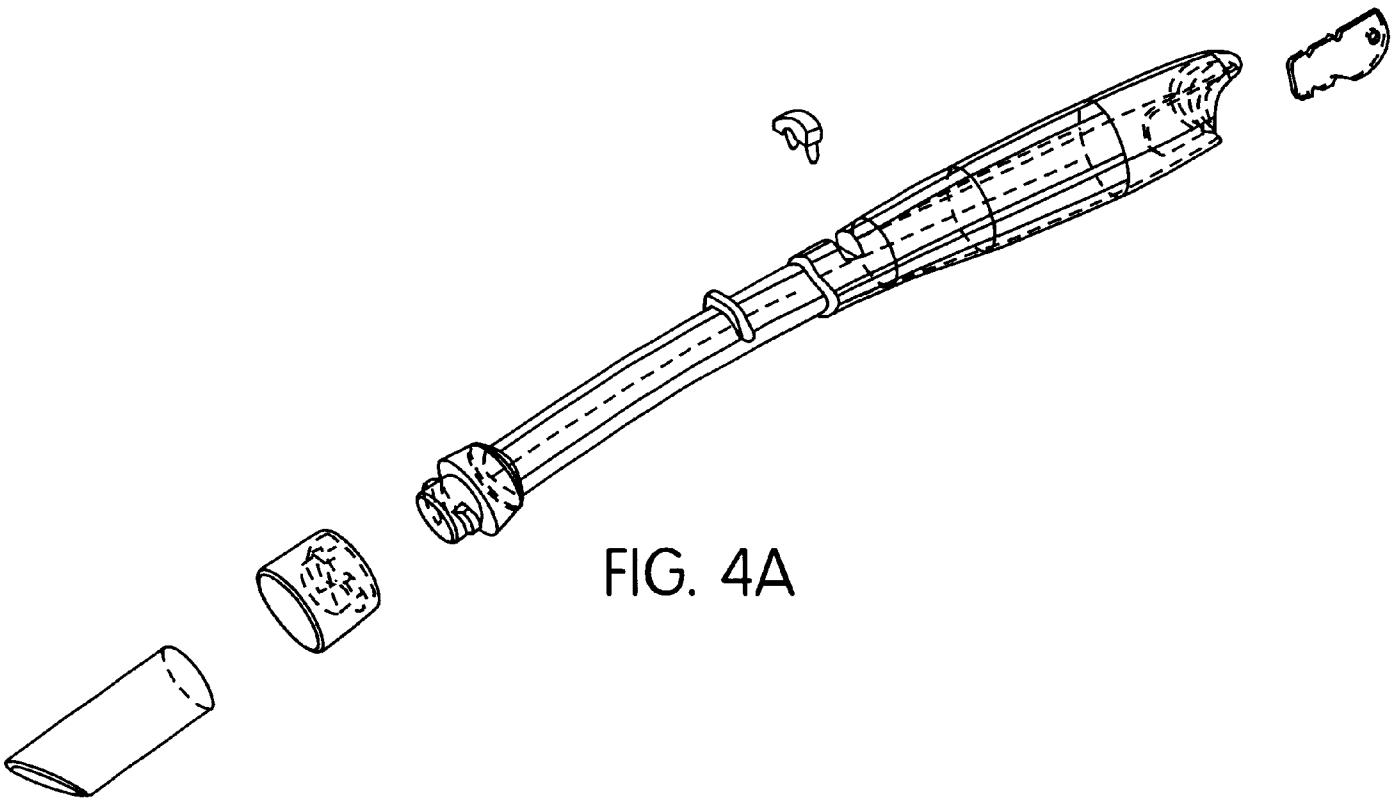
FIG. 4 includes a side perspective diagrammatic exploded view and a side diagrammatic view, FIGS. 4A and 4B respectively, of an exemplary embodiment of a basting brush in accordance with the present invention.
Figure 4B:
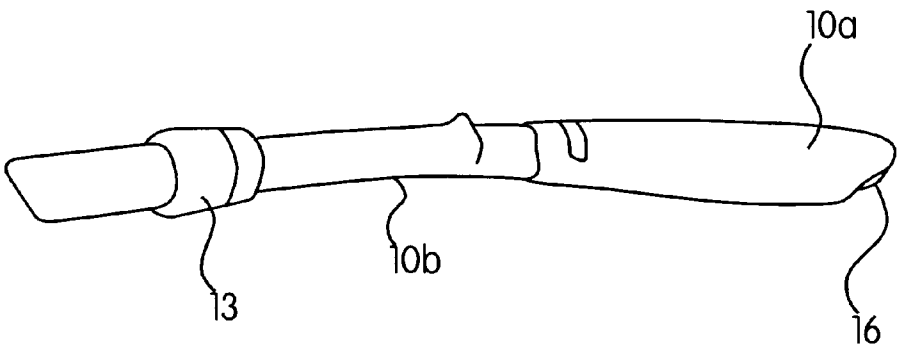

As shown in FIGS. 2 and 4, the handle portion 10 is formed from an elongate shaft having a handle grip section 10*a* which has, for example, a gradually increasing dimension in a direction extending away from the lower section of handle portion 10 forming the handle core section 10*b* which is connected via a relatively narrow neck to the retaining member 13 of the replaceable brush bristle head 12.

The handle portion 10 may be constructed as an integral piece by a variety of methods, for example, by thermoplastic molding.

Figure 3B:
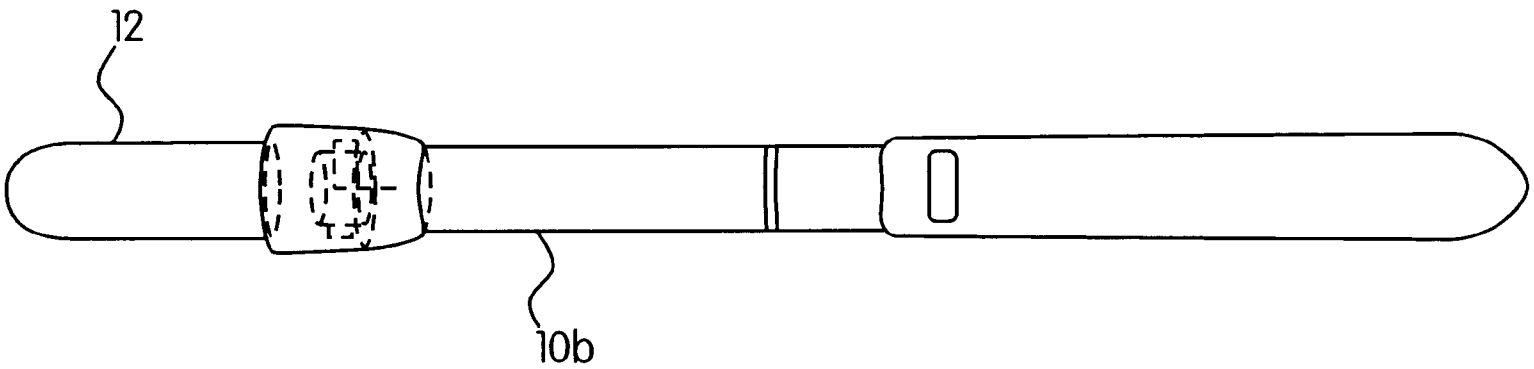
FIG. 3 includes a side view and a top diagrammatic view, FIGS. 3A and 3B respectively, of an exemplary embodiment of a basting brush in accordance with the present invention.
Figure 3A:
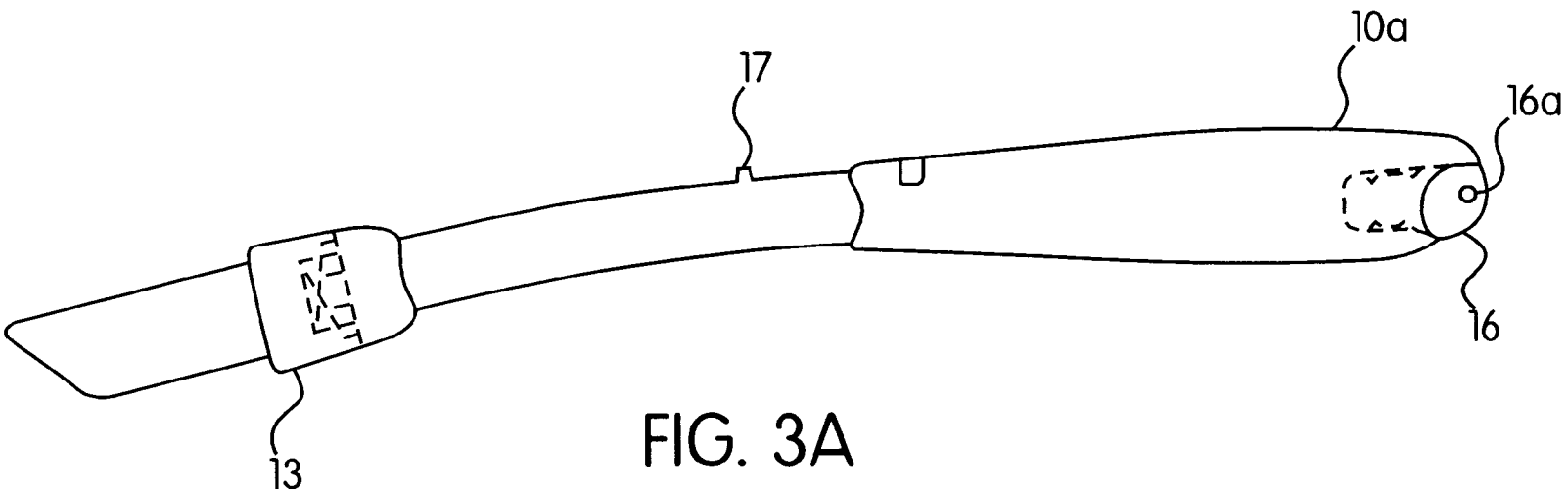

Generally, the handle portion 10 may also be prepared from any relatively strong and thermally insulating material such as wood. The brush handle core portion 10*b* can be formed to any convenient shape and size. The cross-sectional shape of the core handle portion 10*b* may be, for example, square, triangular, round or trapezoidal. As shown in FIGS. 1–5, the brush handle core portion 10*b* is round in the exemplary embodiment, and is about ½" to about ¾" in diameter. For ease of operation, the handle portion 10 is curved slightly downward, as illustrated in FIGS. 1 and 3, so as to enhance the user's comfort. The curvature may be, for example, in a range of about 0 (e.g., straight) to a radius of up to several feet.

The replaceable bristle head portion 12 may be any shape, for example, round, as in the exemplary embodiment, or square or rectangular, and is generally characterized in having a slanting edge with respect to the longitudinal axis of the handle core portion 10*b*, with longer bristles at one side of the brush bristle head and shorter bristles at the opposite side. Such angling provides a more comfortable configuration for basting operations, and permits more convenient application of cooking fluids to foods.

The lower end of the handle core section 10*b* is modified so as to be able to accept the replaceable bristle head portion 12 by means of, for example, a releasable engagement with the retaining member 13. Referring to FIG. 5, an exemplary embodiment of the retaining member 13 is shown. The replaceable bristle head portion 12, which is, for example, detachable, disposable and replaceable with a new head portion, is attached to a fastener member at the lower end of the of handle core section 10*b* by any means of stable attachment known in the art. Possible modes of attachment include bayonet-type, twist-lock or similar type connections.

Referring to FIGS. 2–4, replaceable bristle head portion 12 includes a plurality of brush bristles which are affixed to the retaining member 13 so as to project from the bottom surface thereof, and extend generally vertically and substantially in parallel with the longitudinal axis of the brush handle core portion 10*b*. The brush bristles may be of substantially uniform or variable length, and are stiffly resilient. The brush bristles are between about 1 inch and about 3 inches in length, and may be affixed to the retaining member 13 in a plurality of tufts, each tuft including several bristles. The bristles of the replaceable bristle head portion 12 may be made of a natural or synthetic material.

The bristles may be attached to the retaining member 13 by any method known in the art so as to securely attach the bristles thereto. For example, the bristles may be embedded in a doubled-over manner in holes drilled or otherwise formed in a framework at the lower end of the retaining member 13.

In order to remove the replaceable bristle head portion 12 from the handle core portion lob of a basting brush in accordance with an embodiment of the present invention, torque is applied in opposite directions on the lower end of the handle core portion 10*b* and the retaining member 13, respectively, so as to cause the replaceable bristle head portion 12 to become disengaged from the brush handle. In this manner, a contaminated or soiled bristle portion may be simply removed and replaced with a new replaceable bristle head portion 12 by proceeding in reverse fashion, and thus the whole basting brush need not be discarded when only the bristle portion is no longer useable.

One of skill in the art will readily understand that the present invention is not limited to the specific embodiment shown and described, and may be further used in applications other than grills.

Variations of the present invention may be made which are within the scope of the present invention as defined in the accompanying claims, without departing from the principles of the present invention.

What is claimed is:

1. A basting brush, comprising:

a releasably engageable basting brush head portion, said basting brush head portion including a brush head retaining member and a plurality of brush bristles which are affixed to the brush head retaining member; and a handle portion having a handle core section and a handle grip section at an upper end of the handle core section;

wherein the handle core section includes an elongate shaft having a fastener member which releasably engages the releasably engageable basting brush head portion at a lower end of the handle core section so as to stably secure the releasably engageable basting brush head portion to the handle core section; and wherein the plurality of brush bristles are substantially parallel, project forward along a longitudinal axis formed by the elongate shaft, progressively differ in length, and have free ends that form a slanted plane.

2. The basting brush in accord with claim 1, wherein an end portion of the handle grip section includes a hanging ring having one of a flat metal piece and a flat plastic piece, wherein the hanging ring includes an opening therethrough.

3. The basting brush in accord with claim 2, wherein the hanging ring is permanently connected to the handle grip section.

4. The basting brush in accord with claim 1, wherein the handle grip section includes a soft-grip overmold and the elongate shaft includes a curved elongate shaft.

5. The basting brush in accord with claim 1, wherein a protrusion is disposed on an upper surface of the handle core section.

6. The basting brush in accord with claim 5, wherein the protrusion includes an anti-roll protrusion extending orthogonally from the handle core section.

7. The basting brush in accord with claim 1, wherein the basting brush has an overall length of at least 9 inches.

8. The basting brush in accord with claim 1, wherein the plurality of brush bristles extend at least 1 inch beyond the brush head retaining member.

9. The basting brush in accord with claim 1, wherein the fastener member releasable engages the releasably engageable basting brush head portion using a snap-lock mechanism.

10. The basting brush in accord with claim 1, wherein the fastener member releasable engages the releasably engageable basting brush head portion using a twist-lock mechanism.

11. A basting brush, comprising:

a releasably engageable basting brush head portion, said basting brush head portion including a brush head retaining member and a plurality of brush bristles which are affixed to the brush head retaining member; and a handle portion having a handle core section and a handle grip section at an upper end of the handle core section;

wherein the handle core section includes a curved elongate shaft having a fastener member which releasably engages the releasably engageable basting brush head portion at a lower end of the handle core section so as to stably secure the releasably engageable basting brush head portion to the handle core section; and wherein the plurality of brush bristles are substantially parallel and project forward along a longitudinal axis formed by the curved elongate shaft.

12. The basting brush in accord with claim 11, wherein the basting brush has an overall length of at least 9 inches.

13. The basting brush in accord with claim 11, wherein the plurality of brush bristles extend at least 1 inch beyond the brush head retaining member.

14. The basting brush in accord with claim 11, wherein the fastener member releasable engages the releasably engageable basting brush head portion using one of a snap-lock mechanism and a twist-lock mechanism.

15. A basting brush, comprising:

a releasably engageable basting brush head portion, said basting brush head portion including a brush head retaining member and a plurality of brush bristles which are affixed to the brush head retaining member; and a handle portion having a handle core section and a handle grip section at an upper end of the handle core section;

wherein the handle core section includes a curved elongate shaft having a fastener member which releasably engages the releasably engageable basting brush head portion at a lower end of the handle core section so as to stably secure the releasably engageable basting brush head portion to the handle core section; and wherein the plurality of brush bristles are substantially parallel, progressively differ in length, and have free ends that form a slanted plane.

16. The basting brush in accord with claim 15, wherein the basting brush has an overall length of at least 9 inches.

17. The basting brush in accord with claim 15, wherein the plurality of brush bristles extend at least 1 inch beyond the brush head retaining member.

18. The basting brush in accord with claim 15, wherein the curved elongate shaft curves toward the slanted plane formed by the free ends of the plurality of brush bristles.

19. The basting brush in accord with claim 15, wherein the fastener member releasable engages the releasably engageable basting brush head portion using one of a snap-lock mechanism and a twist-lock mechanism.

20. The basting brush in accord with claim 15, wherein the plurality of brush bristles project forward along a longitudinal axis formed by the curved elongate shaft.

* * * * *